US011571053B2

(12) United States Patent
Gaynor et al.

(10) Patent No.: US 11,571,053 B2
(45) Date of Patent: Feb. 7, 2023

(54) ADJUSTABLE STORAGE BAG

(71) Applicant: NIKE, Inc., Beaverton, OR (US)

(72) Inventors: Melissa R. Gaynor, Portland, OR (US); Carl Behrend, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 397 days.

(21) Appl. No.: 16/702,005

(22) Filed: Dec. 3, 2019

(65) Prior Publication Data

US 2020/0178664 A1 Jun. 11, 2020

Related U.S. Application Data

(60) Provisional application No. 62/775,475, filed on Dec. 5, 2018.

(51) Int. Cl.
*A45C 13/02* (2006.01)
*A45C 7/00* (2006.01)

(52) U.S. Cl.
CPC ..... *A45C 13/02* (2013.01); *A45C 7/009* (2013.01); *A45C 2013/026* (2013.01)

(58) Field of Classification Search
CPC .... A45C 13/02; A45C 7/009; A45C 2013/026
See application file for complete search history.

(56) References Cited

U.S. PATENT DOCUMENTS 3,904,258 A * 9/1975 Faulkenberry ..... A47B 43/04 108/164
4,561,576 A * 12/1985 Lowe ..... A45C 11/38 224/652
4,609,084 A * 9/1986 Thomas ..... A61F 17/00 190/110
5,090,526 A * 2/1992 Jacober ..... A45C 7/0077 383/110
5,967,406 A * 10/1999 Moorman ..... B65D 5/324 206/427

(Continued)

FOREIGN PATENT DOCUMENTS

JP S61199226 U 12/1986
JP 2005137523 A 6/2005
JP 2007195874 A 8/2007

OTHER PUBLICATIONS

European Patent Office (ISA), International Search Report and Written Opinion for International Application No. PCT/US2019/064359, dated Feb. 26, 2020.

*Primary Examiner* — Tri M Mai
(74) *Attorney, Agent, or Firm* — Bookoff McAndrews, PLLC

(57) ABSTRACT

A portable pack includes a bag having a chamber defined by an end wall, a first side wall extending from the end wall, and a second side wall extending from the end wall and spaced apart from the first side wall. A distance between the first side wall and the second side wall defines a width of the chamber. The portable pack also includes an inner wall having a central panel, a first end panel connected to a first end of the central panel by a first living hinge and connected to the first side wall by a second living hinge, and a second end panel connected to a second end of the central panel by a third living hinge and to the second side wall by a fourth living hinge.

20 Claims, 4 Drawing Sheets

(56) References Cited

U.S. PATENT DOCUMENTS

| | | | | |
|---|---|---|---|---|
| 8,033,405 | B2 * | 10/2011 | Wang | A47B 43/02 211/118 |
| 8,281,950 | B2 * | 10/2012 | Potts | A45C 7/0077 220/531 |
| 8,985,432 | B2 * | 3/2015 | Cullen | B65D 5/36 206/170 |
| 9,211,002 | B2 * | 12/2015 | Lo | A47B 47/06 |
| 9,615,642 | B2 | 4/2017 | Bergh et al. | |
| 2019/0298017 | A1 * | 10/2019 | Potts | B65D 25/14 |

* cited by examiner

ADJUSTABLE STORAGE BAG

CROSS REFERENCE TO RELATED APPLICATIONS

This non-provisional U.S. Patent Application claims priority under 35 U.S.C. § 119(e) to U.S. Provisional Patent Application Ser. No. 62/775,475, filed Dec. 5, 2018, the disclosure of which is hereby incorporated by reference in its entirety.

FIELD

The present disclosure relates generally to portable packs or bags, and more particularly, to portable packs having adjustable interior walls.

BACKGROUND

This section provides background information related to the present disclosure which is not necessarily prior art.

Portable bags or packs are often used to store and transport various goods, such as athletic apparel and equipment. Traditionally, bags or packs are provided with a single chamber or a plurality of predefined chambers. Alternatively, bags or packs may be provided with partitions that can be added to and removed from the bag to modify the compartment. However, there remains a need in the art for bags and packs having interior chambers that can be quickly and easily modified without the need to add or remove components of the bag.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
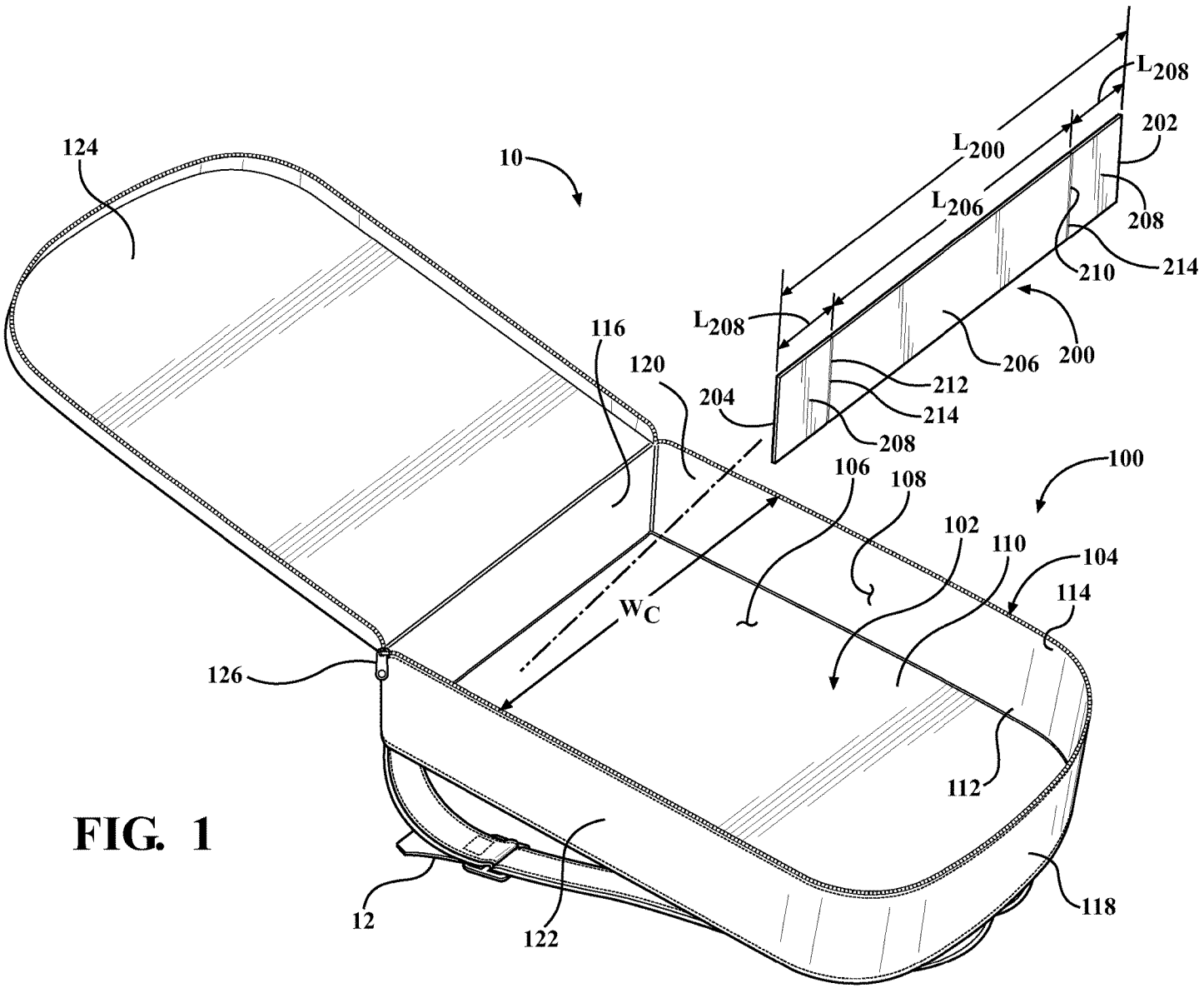
FIG. 1 is an exploded view of a portable pack according the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a portable pack. The portable pack includes a bag having a chamber defined by an end wall, a first side wall extending from the end wall, and a second side wall extending from the end wall and spaced apart from the first side wall. A distance between the first side wall and the second side wall defines a width of the chamber. The portable pack also includes an inner wall having a central panel, a first end panel connected to a first end of the central panel by a first living hinge and connected to the first side wall by a second living hinge, and a second end panel connected to a second end of the central panel by a third living hinge and to the second side wall by a fourth living hinge.

Implementations of the disclosure may include one or more of the following optional features. In some implementations, the inner wall is operable between a first position having the central panel disposed adjacent to the end wall of the bag and a second position having the central panel spaced apart from the end wall of the bag. Here, when the inner wall is in the second position, the chamber is partitioned into a first sub-chamber and a second sub-chamber.

In some configurations, each of the central panel, the first end panel, and the second end panel are formed of a rigid or semi-rigid material. A length of the central panel may be substantially similar to the width of the chamber. A length of the inner wall from the first living hinge to the fourth living hinge may be greater than the width of the chamber.

In some examples, the central panel, the first end panel, and the second end panel are formed of a first material and the at least one of the living hinges is formed of a second material. In other examples, the central panel, the first end panel, and the second end panel are integrally formed of a first material. The bag may include a fastener configured to removably attach the inner wall to the bag. Optionally, the portable pack may include a closure panel operable between a first position to enclose the chamber and a second position to expose the chamber.

Another aspect of the disclosure provides a portable pack including a bag having a chamber defined by an end wall, a first side wall extending from the end wall, and a second side wall extending from the end wall and spaced apart from the first side wall. A distance between the first side wall and the second side wall defines a width of the chamber. The portable pack also includes an inner wall having a first end pivotally attached to the first side wall and a second end disposed at an opposite end of the inner wall from the first end and pivotally attached to the second side wall. A distance from the first end to the second end defines a length of the inner wall that is greater than the width of the chamber.

This aspect may include one or more of the following optional features. In some implementations, the inner wall includes a central panel, a first end panel pivotally attached to a first end of the central panel, and a second end panel pivotally attached to a second end of the central panel. The first end panel may be attached to the first end of the central panel by a first living hinge and the second end panel may be attached to the second end of the central panel by a second living hinge. Each of the central panel, the first end panel, and the second end panel may be formed of a rigid or semi-rigid material. A length of the central panel may be substantially similar to the width of the chamber. The central panel, the first end panel, and the second end panel may be separately formed.

In some examples the inner wall is operable between a first position having a first portion of the inner wall disposed adjacent to the end wall and a second position having the first portion of the inner wall spaced apart from the end wall. Additionally or alternatively, the first end of the inner wall may be attached to the first side wall by a first living hinge and the second end of the inner wall may be attached to the second side wall by a second living hinge. The bag may include a fastener configured to removably attach the inner wall to the bag. The portable pack may also include a closure panel operable between a first position to enclose the chamber and a second position to expose the chamber.

Referring to FIG. 1, a pack 10 according to the instant disclosure includes a bag 100 and an adjustable inner wall 200. In some examples, the pack 10 may include one or more straps 12 for carrying the pack 10. In the illustrated example, the pack 10 includes a pair of straps 12 so that the pack 10 can be worn as a backpack 10. However, in other examples, the pack 10 may be configured as a duffle bag, briefcase, or other type of portable pack.

Figure 2:
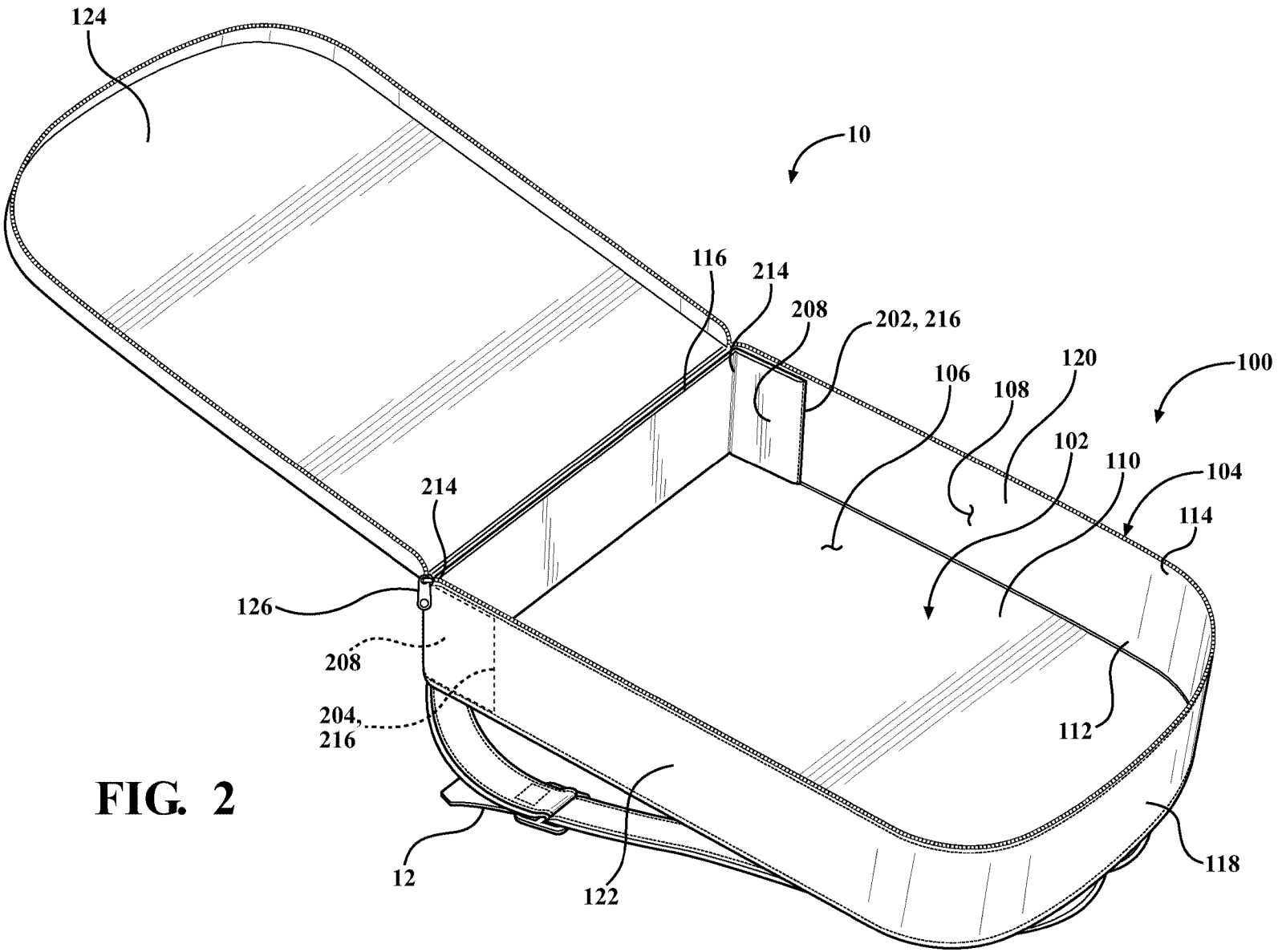
FIG. 2 is a top perspective view of a portable pack according to the principles of the present disclosure with an inner wall of the pack in a first position.
Figure 3:
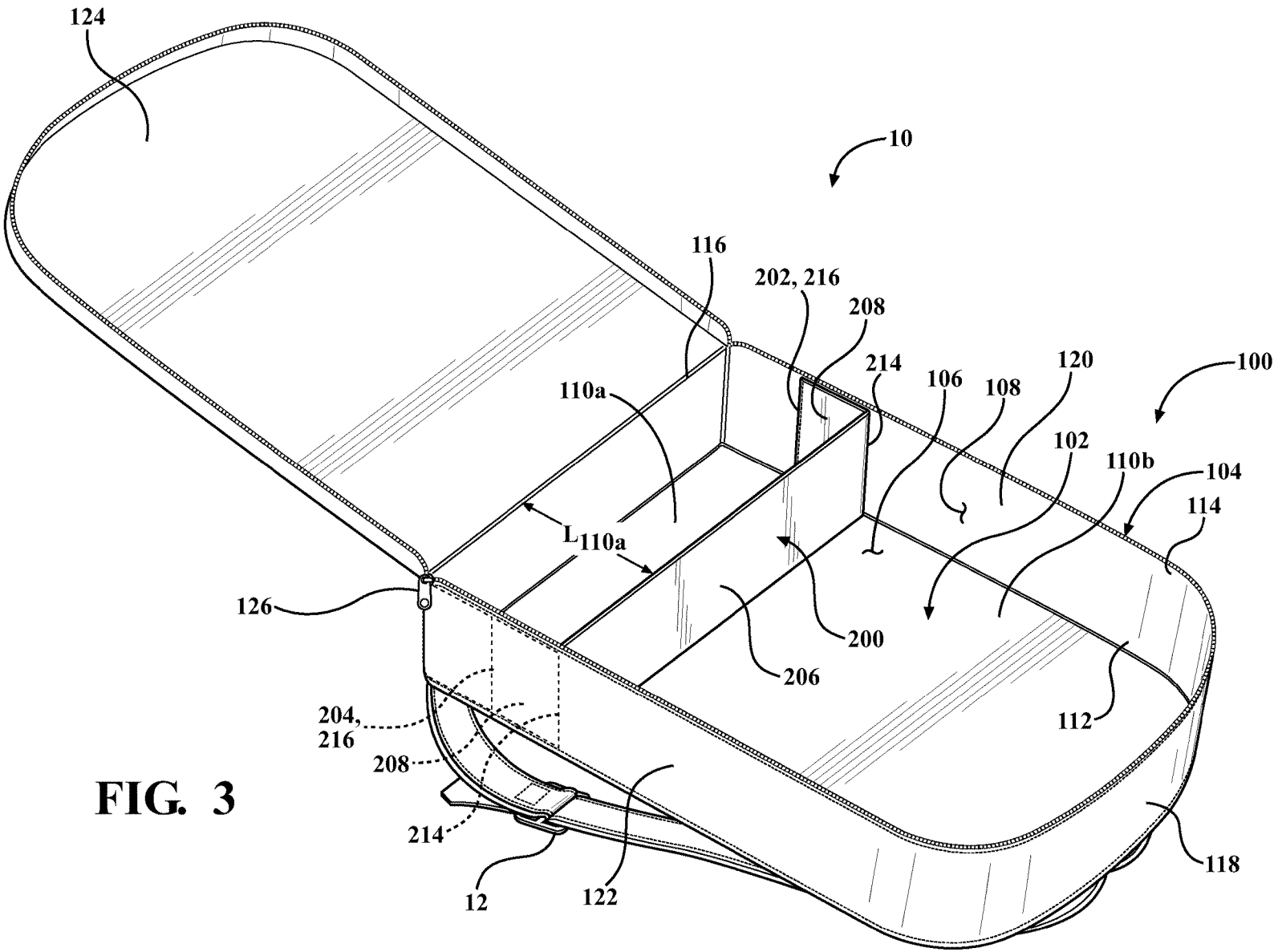
FIG. 3 is a top perspective view of the portable pack of FIG. 2 with the inner wall of the pack in a second position.
Figure 4:
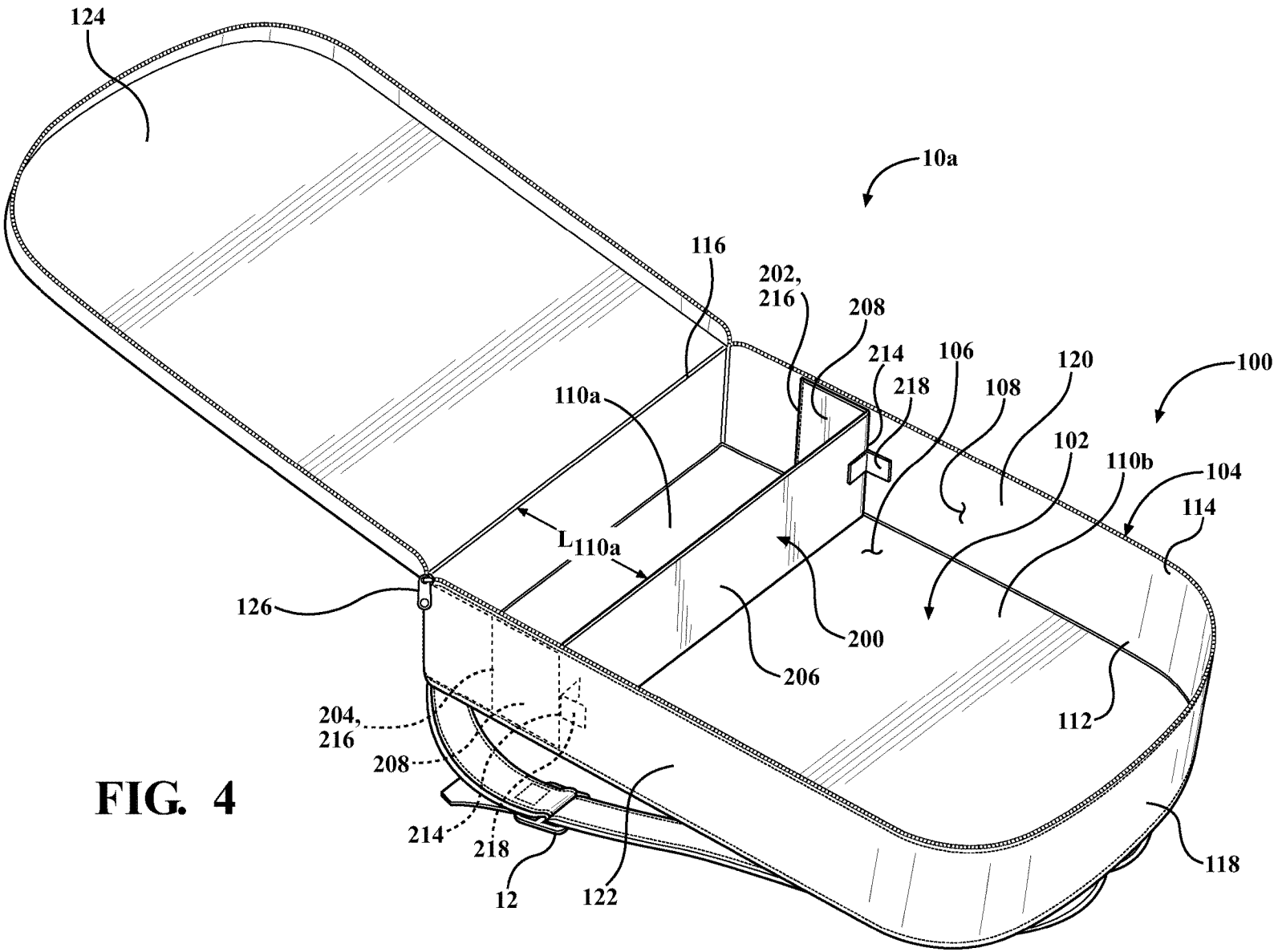
FIG. 4 is a top perspective view of another portable pack according to the principles of the present disclosure.

With reference to FIGS. 2 and 3, the inner wall 200 is operable between a first position and a second position. In the first position, the inner wall 200 is disposed against a sidewall of the bag 100 and provides reinforcement to the sidewall. In the second position (FIG. 3), the inner wall 200 is spaced apart from the sidewall of the bag 100 and partitions a chamber of the bag 100 into one or more sub-chambers, as described in greater detail below.

With continued reference to FIG. 1, the bag 100 includes a base panel 102 and a peripheral wall 104 extending at a transverse angle from an outer perimeter of the base panel 102. Accordingly, an inner surface 106 of the base panel 102 and an inner surface 108 of the peripheral wall 104 cooperate to define a chamber 110 of the bag 100. The peripheral wall 104, or portions thereof, may be described as including a proximal end 112 attached to the base panel 102 and a distal end 114 disposed at an opposite end from the proximal end 112. The distal end 114 of the peripheral wall 104 defines an opening into the chamber 110.

In the illustrated example, the peripheral wall 104 can be described as including a first end wall 116 extending from a first end of the base panel 102, a second end wall 118 extending from a second end of the base panel 102 opposite the first end wall 116, a first side wall 120 extending along a first side of the bag 100 from the first end wall 116 to the second end wall 118, and a second side wall 122 extending along a second side of the bag 100 from the first end wall 116 to the second end wall 118. As shown, each of the first end wall 116, the first side wall 120, and the second side wall 122 are substantially planar. As shown, the second end wall 118 may extend along an arcuate path from the first side wall 118 to the second side wall 122. However, in other examples, the second end wall 118 may also be substantially planar.

The first side wall 120 and the second side wall 122 are substantially parallel to and spaced apart from each other to define a width $W_C$ of the chamber 110. More specifically, a distance between the portions of the inner surface 108 formed by the first side wall 120 and the second side wall 122 defines the width $W_C$ of the chamber 110 of the bag 100.

The bag 100 further includes a cover panel 124 operable to selectively enclose and expose the chamber 110 of the bag 100. In the illustrated example, the cover panel 124 is attached to the first end wall 116 of the bag 100. For example, the cover panel 124 may be attached to the first end wall 116 by a living hinge, whereby a flexible piece of material connects the cover panel 124 to the distal end 114 along the first end wall 116. The cover panel 124 may further include a fastener 126 for securing the cover panel 124 to the peripheral wall 104 to enclose the chamber 110. In the illustrated example, the fastener 126 is a zipper extending around a perimeter of the cover panel 124 and is configured to selectively secure the cover panel 124 to the portions of the distal end 114 of the peripheral wall 104 formed by the first side wall 120, the second end wall 118, and the second side wall 122. In other examples, the fastener 126 may include hook-and-loop fasteners, buttons, snaps, or the like.

Each of the base panel 102, the peripheral wall 104, and the cover panel 124 may be formed of substantially pliable materials, such as foams, fabrics, or combinations thereof. In some examples, the base panel 102 and the peripheral wall 104 may be formed of a cushioning material, such as polymer foam, and may be covered with a fabric material to impart properties of abrasion resistance and water resistance, for example.

With continued reference to FIG. 1, the inner wall 200 extends from a first end 202 to a second end 204 formed at the opposite end of the inner wall 200 from the first end 202. The inner wall 200 includes a central panel 206 and a pair of end panels 208 each pivotally attached to opposite ends of the central panel 206, as described below. Each of the panels 206, 208 is formed of a rigid or semi-rigid material, such as plastic, metal, or a composite material. Particularly, the panels 206, 208 are formed to have a greater stiffness than the peripheral wall 104 of the bag 100. In some examples, the panels 206, 208 may have a rigid inner layer and a resilient or soft outer layer to provide cushioning to the panels 206, 208.

As shown in FIG. 1, the central panel 206 includes a first end 210 and a second end 212 formed at an opposite end of the central panel 206 from the first end 210. A first one of the end panels 208 is attached to the first end 210 of the central panel 206 and extends between the first end 210 of the central panel 206 and the first end 202 of the inner wall 200. Likewise, a second one of the end panels 208 is attached to the second end 212 of the central panel 206 and extends between the second end 212 of the central panel 206 and the second end of the inner wall 200.

Referring still to FIG. 1, a distance from the first end 202 to the second end 204 of the inner wall 200 defines an overall length $L_{200}$ of the inner wall 200, which is greater than the width $W_C$ of the chamber 110 of the bag 100. A distance between the first end 210 of the central panel 206 and the second end 212 of the central panel 206 defines a length $L_{206}$ of the central panel 206 that is substantially similar to, but less than the width $W_C$ of the chamber 110. Particularly, the length $L_{206}$ of the central panel 206 is sized to be substantially similar to the width We of the chamber, whereby only minimal clearance exists between the ends 210, 212 of the central panel 206 and the inner surface 108 when a longitudinal axis of the central panel 206 is perpendicular to the side walls 120, 122. Accordingly, when the inner wall 200 is disposed within the chamber 110, the central panel 206 is sized to extend between the portion of the inner surface 108 formed by the first side wall 120 and the portion of the inner surface 108 formed by second side wall 122, while the end panels 208 are configured to extend along the inner surface 108.

In some examples, each of the panels 206, 208 are separately formed of a rigid or semi-rigid material and are pivotally attached to each other by hinges 214. For example, the first one of the end panels 208 is attached to the first end 210 of the central panel 206 by a first living hinge 214 and the second one of the end panels 208 is attached to the second end 212 of the central panel 206 by a second living hinge 214. In some examples, the living hinges 214 may be formed of a different material than the panels 206, 208. For example, the panels 206, 208 may be disposed within individual compartments of a fabric sleeve (not shown), whereby each of the compartments is separated by a fabric living hinge. In other examples, the panels 206, 208 and the hinges 214 may be integrally formed from a single material. For example, the entire inner wall 200 could be formed of a polymeric material, whereby the panels 206, 208 each have a first thickness providing a first stiffness and the living hinges 214 have a second thickness providing a second stiffness that is less than the first stiffness.

Referring now to FIGS. 2 and 3, when the inner wall 200 is assembled within the bag 100, the first end 202 of the inner wall 200 is pivotally attached to the inner surface 108 of the peripheral wall 104 by a first hinge 216 and the second end 204 of the inner wall 200 is pivotally attached to the inner surface 108 of the peripheral wall 104 by a second hinge 216. In some examples, the hinges 216 connecting the ends 202, 204 of the inner wall 200 to the inner surface 108 of the bag 100 are living hinges, which may be formed by attaching the ends 202, 204 of the inner wall 200 to the inner surface 108 with a flexible material. Namely, the ends 202, 204 may be attached to the inner surface 108 by stitching and/or an adhesive that permits the panels 208 to rotate relative to the inner surface 108 about the respective ends 202, 204.

With continued reference to FIGS. 2 and 3, the inner wall 200 is operable between a first position (FIG. 2) where the central panel 206 is positioned against and substantially parallel to the first end wall 116 of the bag 100, and a second position (FIG. 3) where the central panel 206 is spaced apart from and substantially parallel to the first end wall 116 of the bag 100.

As shown in FIG. 2, when the inner wall 200 is in the first position, the central panel 206 is disposed adjacent to or against the first end wall 116 of the bag 100 to provide a rigid or semi-rigid support structure along the first end wall 116 of the bag 100. Here, the chamber 110 of the bag 100 is undivided by the central panel 206 and provides a storage space having a first volume. Furthermore, by positioning the central panel 206 against the first end wall 116 of the bag 100, the first end wall 116 is supported by the stiffness of the central panel 206. Thus, when the pack 10 is carried in an upright position (i.e., the first end wall 116 on the bottom), the central panel 206 provides added structural integrity to the bottom of the pack 10.

With continued reference to FIG. 2, when the inner wall 200 is in the first position with the central panel 206 disposed adjacent to the first end wall 116, the end panels 208 of the inner wall 200 extend along and substantially parallel to the inner surface 108 on the first side wall 120 and the second side wall 122 in a direction towards the first end wall 116. Particularly, a first one of the end panels 208 extends from the living hinge 216 connecting the first end 202 of the inner wall 200 to the first side wall 120, and towards the first end wall 116 to the living hinge 214 at the first end 210 of the central panel 206. Conversely, the second one of the end panels 208 extends from the living hinge 216 connecting the second end 204 of the inner wall 200 to the second side wall 122, and towards the first end wall 116 to the living hinge 214 at the second end 212 of the central panel 206.

As shown in FIG. 3, when the inner wall 200 is in the second position the central panel 206 is spaced apart from the first end wall 116 of the bag 100. Here, the chamber 110 of the bag 100 is partitioned by the central panel 206 into a first sub-chamber 110*a* having a second volume and a second sub-chamber 110*b* having a third volume. The combined volume of the second volume and the third volume is substantially similar to the first volume of the undivided chamber 110. In some examples, the first sub-chamber 110*a* or the second sub-chamber 110*b* may be sized to store a particular type of item. For example, the first sub-chamber 110*a* formed between the first end wall 116 and the central panel 206 may be appropriately sized to store a single pair of shoes separately from garments.

With continued reference to FIG. 3, when the inner wall 200 is in the second position with the central panel 206 spaced apart from the first end wall 116, the end panels 208 of the inner wall 200 extend along and substantially parallel to the inner surface 108 on the first side wall 120 and the second side wall 122 in a direction away from the first end wall 116. Particularly, a first one of the end panels 208 extends from the living hinge 216 connecting the first end 202 of the inner wall 200 to the first side wall 120, and away from the first end wall 116 to the living hinge 214 at the first end 210 of the central panel 206. Conversely, the second one of the end panels 208 extends from the living hinge 216 connecting the second end 204 of the inner wall 200 to the second side wall 122, and away from the first end wall 116 to the living hinge 214 at the second end of the central panel 206. In so doing, the end panels 208 are rotated substantially 180 degrees about their respective living hinge 216 when the inner wall 200 is moved from the first position to the second position.

With continued reference to FIG. 3, the size of the first sub-chamber 110*a* is determined by the size and position of the end panels 208 of the inner wall 200. For example, in the illustrated example the living hinges 216 attaching the inner wall 200 to the inner surface 108 of the peripheral wall 104 are spaced apart from the first end wall 116 of the bag 100 by a distance substantially equal to the length $L_{208}$ of the end panels 208, such that the length $L_{110a}$ of the first sub-chamber 110*a* is approximately double the length $L_{208}$ of the end panels 208. Again, these dimensions may be selected to accommodate a particular article, such as a pair of shoes, skates, or other item that may be desirable to store separately from garments.

To move the inner wall 200 from the first position to the second position, a user can bias the central panel 206 towards the desired position. Although somewhat rigid, each of the panels 206, 208 and the peripheral wall 104 are flexible enough to allow the inner wall 200 to be moved from the first position to the second position without needing to remove the inner wall 200 from the bag 100. Because the length $L_{200}$ of the inner wall 200 is greater than the width $W_C$ of the chamber 110 and the length $L_{206}$ of the central panel 206 is less than the width $W_C$ of the chamber 110, the rigid or semi-rigid nature of the panels 206, 208 causes the inner wall to "snap" into each of the first position and the second position, whereby the inner wall 200 will be retained in one of the respective positions by the stiffness of the panels 206, 208 unless biased towards the other one of the respective positions.

In another example of the pack 10*a*, shown in FIG. 3, the inner wall 200 may be provided with a fastener 218 for securing the position of the inner wall 200 relative to the peripheral wall 104 of the bag. For example, as shown in FIG. 3, the fastener 218 may include one or more straps 218 configured to removably attach the central panel 206 to the inner surface 108 of the peripheral wall 104. Here, one or both ends of the strap 218 may be removably attached to the central panel 206 and/or the inner surface 108 by a fastener, such as a button, a snap, or hook-and-loop, for example. In other examples, fasteners may be provided on one or both faces of the end panels 208 and configured to interface with corresponding fasteners on the inner surface 108 of the peripheral wall 104 to secure the inner wall 200 in the first position and/or the second position.

The following Clauses provide an exemplary configuration for a pack described above.

Clause 1: A portable pack comprising a bag having a chamber defined by an end wall, a first side wall extending from the end wall, and a second side wall extending from the end wall and spaced apart from the first side wall, a distance between the first side wall and the second side wall defining a width of the chamber, and an inner wall having a central panel, a first end panel connected to a first end of the central panel by a first living hinge and connected to the first side wall by a second living hinge, and a second end panel connected to a second end of the central panel by a third living hinge and to the second side wall by a fourth living hinge.

Clause 2: The portable pack of Clause 1, wherein the inner wall is operable between a first position having the central panel disposed adjacent to the end wall of the bag and a second position having the central panel spaced apart from the end wall of the bag.

Clause 3: The portable pack of Clause 2, wherein when the inner wall is in the second position the chamber is partitioned into a first sub-chamber and a second sub-chamber.

Clause 4: The portable pack of Clause 1, wherein each of the central panel, the first end panel, and the second end panel are formed of a rigid or semi-rigid material.

Clause 5: The portable pack of Clause 1, wherein a length of the central panel is substantially similar to the width of the chamber.

Clause 6: The portable pack of Clause 1, wherein a length of the inner wall from the first living hinge to the fourth living hinge is greater than the width of the chamber.

Clause 7: The portable pack of Clause 1, wherein the central panel, the first end panel, and the second end panel are formed of a first material and the at least one of the living hinges is formed of a second material.

Clause 8: The portable pack of Clause 1, wherein the central panel, the first end panel, and the second end panel are integrally formed of a first material.

Clause 9: The portable pack of Clause 1, wherein the bag includes a fastener configured to removably attach the inner wall to the bag.

Clause 10: The portable pack of Clause 1, further comprising a closure panel operable between a first position to enclose the chamber and a second position to expose the chamber.

Clause 11: A portable pack comprising a bag having a chamber defined by an end wall, a first side wall extending from the end wall, and a second side wall extending from the end wall and spaced apart from the first side wall, a distance between the first side wall and the second side wall defining a width of the chamber, and an inner wall having a first end pivotally attached to the first side wall and a second end disposed at an opposite end of the inner wall from the first end and pivotally attached to the second side wall, a distance from the first end to the second end defining a length of the inner wall that is greater than the width of the chamber.

Clause 12: The portable pack of Clause 11, wherein the inner wall includes a central panel, a first end panel pivotally attached to a first end of the central panel, and a second end panel pivotally attached to a second end of the central panel.

Clause 13: The portable pack of Clause 12, wherein the first end panel is attached to the first end of the central panel by a first living hinge and the second end panel is attached to the second end of the central panel by a second living hinge.

Clause 14: The portable pack of Clause 12, wherein each of the central panel, the first end panel, and the second end panel are formed of a rigid or semi-rigid material.

Clause 15: The portable pack of Clause 12, wherein a length of the central panel is substantially similar to the width of the chamber.

Clause 16: The portable pack of Clause 12, wherein the central panel, the first end panel, and the second end panel are separately formed.

Clause 17: The portable pack of Clause 11, wherein the inner wall is operable between a first position having a first portion of the inner wall disposed adjacent to the end wall and a second position having the first portion of the inner wall spaced apart from the end wall.

Clause 18: The portable pack of Clause 11, wherein the first end of the inner wall is attached to the first side wall by a first living hinge and the second end of the inner wall is attached to the second side wall by a second living hinge.

Clause 19: The portable pack of Clause 11, wherein the bag includes a fastener configured to removably attach the inner wall to the bag.

Clause 20: The portable pack of Clause 11, further comprising a closure panel operable between a first position to enclose the chamber and a second position to expose the chamber.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A portable pack comprising:

a bag having a chamber defined by an end wall, a first side wall extending from the end wall, and a second side wall extending from the end wall and spaced apart from the first side wall, a distance between the first side wall and the second side wall defining a width of the chamber;

an inner wall having a central panel, a first end panel connected to a first end of the central panel by a first living hinge and connected to the first side wall by a second living hinge, and a second end panel connected to a second end of the central panel by a third living hinge and to the second side wall by a fourth living hinge;

a first fastener including one or more straps, wherein the first fastener is configured to removably attach the central panel to the first side wall; and a second fastener including one or more straps, wherein the second fastener is configured to removably attach the central panel to the second side wall, wherein:

the inner wall is operable between a first position having the central panel spaced apart from the end wall of the bag and a second position having the central panel abutting the end wall of the bag, and the central panel is configured such that, in the second position, the central panel adds structural integrity to a bottom of the portable pack such that the bottom of the portable pack has a greater structural integrity in the second position than in the first position.

2. The portable pack of claim 1, wherein:

in the first position, the inner wall is configured to maintain a partition of the chamber in the bag during transport, and each of the central panel, the first panel, and the second panel include a semi-rigid material having a stiffness greater than stiffnesses of the end wall, the first side wall, the second side wall, the first living hinge, the second living hinge, the third living hinge, and the fourth living hinge.

3. The portable pack of claim 1, further comprising:

a pliable cover panel provided at a first side of the bag and extending between the first and second side walls, the pliable cover panel operable between a first position to enclose the chamber and secure at least one item stored in the chamber during transport and a second position to expose an inside of the chamber; and a pair of straps coupled to a second side of the bag opposite the first side, the pair of straps being arranged to allow the portable pack to be worn as a backpack;

wherein the end panel, the first side wall, the second side wall, the cover panel, the first living hinge, the second living hinge, the third living hinge, and the fourth living hinge include a fabric material, and a stiffness of each of the central panel, the first panel, and the second panel is greater than a stiffness of the pliable cover panel.

4. The portable pack of claim 1, wherein each of the central panel, the first end panel, and the second end panel are formed of a rigid or semi-rigid polymeric material.

5. The portable pack of claim 1, wherein a length of the central panel is substantially similar to the width of the chamber, and a length of the inner wall from the first living hinge to the fourth living hinge is greater than the width of the chamber.

6. The portable pack of claim 1, wherein the end wall, the first side wall, and the second side wall include a cushioning material.

7. The portable pack of claim 1, wherein each of the central panel, the first end panel, and the second end panel have a soft outer layer configured to provide cushioning.

8. The portable pack of claim 1, wherein the central panel, the first end panel, and the second end panel are integrally formed of a polymeric material, wherein the first, second, third, and fourth living hinges have a thickness less than a thickness of the central panel, the first end panel, and the second end panel.

9. The portable pack of claim 1, wherein the first fastener includes a tab having a first end configured to couple to the central panel and a second end configured to couple to the first side wall, and the second fastener includes a tab having a first end configured to couple to the central panel and a second end configured to couple to the second side wall.

10. The portable pack of claim 9, wherein the central panel includes the first end of the tab of the first fastener and the first end of the tab of the second fastener.

11. A portable pack comprising:

a bag having a chamber defined by an end wall, a first side wall extending from the end wall, and a second side wall extending from the end wall and spaced apart from the first side wall, a distance between the first side wall and the second side wall defining a width of the chamber, the bag including a cushioning material;

an inner wall having a first end pivotally attached to the first side wall and a second end disposed at an opposite end of the inner wall from the first end and pivotally attached to the second side wall, a distance from the first end to the second end defining, wherein a length of the inner wall that is greater than the width of the chamber, wherein the inner wall includes a central panel operable between a first position having the central panel spaced apart from the end wall and a second position having the central panel abutting the end wall;

a first fastener including one or more straps, wherein the first fastener is configured to removably attach the central panel to the first side wall; and a second fastener including one or more straps, wherein the second fastener is configured to removably attach the central panel to the second side wall, and wherein:

the end wall is pliable, and a material and/or stiffness of the central panel is configured such that, in the second position, the central panel adds structural integrity to a bottom of the portable pack such that the bottom of the portable pack has a greater structural integrity in the second position than in the first position.

12. The portable pack of claim 11, wherein the inner wall includes a first end panel pivotally attached to a first end of the central panel, and a second end panel pivotally attached to a second end of the central panel.

13. The portable pack of claim 12, wherein a length of the central panel is substantially similar to the width of the chamber and the end panel, and wherein the first end panel is attached to the first end of the central panel by a first living hinge and the second end panel is attached to the second end of the central panel by a second living hinge.

14. The portable pack of claim 12, wherein each of the central panel, the first end panel, and the second end panel include a polymeric material.

15. The portable pack of claim 11, further comprising:

a pliable cover panel coupled to the end wall via a piece of fabric, the cover panel being configured to fasten to the bag to enclose the chamber; and at least one strap configured to allow the portable pack to be carried on at least one shoulder of a user to transport at least one item stored in the chamber.

16. The portable pack of claim 11, wherein the first fastener includes a tab having a first end attached to the central panel and a second end configured to removably attach to the first side wall, and the second fastener includes a tab having a first end attached to the central panel and a second end configured to removably attach to the second side wall.

17. The portable pack of claim 15, wherein:

the inner wall includes a polymer foam surrounded by water-resistant fabric;

the cover panel includes a foam and/or a fabric; and at least a portion of the cover panel is configured to zip to the first side wall and/or the second side wall.

18. The portable pack of claim 11, wherein the inner wall includes a semi-rigid material configured to maintain a partition of the chamber during transport, wherein the semi-rigid material is more stiff than the cushioning material of the bag.

19. A portable backpack configured to store at least one item during transport, comprising:

a bag which is pliable and has a chamber defined by a base panel and a peripheral wall, the peripheral wall including an end wall at a bottom of the backpack, a first side wall extending from the end wall and a second side wall extending from the end wall and spaced apart from the first side wall, wherein the base panel and the peripheral wall include a cushioning material;

a cover panel which is pliable and coupled to the end wall via a first living hinge to face the base panel, the cover panel operable between a first position to enclose and cover the chamber and a second position to expose the chamber;

a pair of straps coupled to the base panel and arranged to allow the portable backpack to be worn as a backpack;

an inner wall having a central panel, a first end panel connected to a first end of the central panel by a second living hinge and connected to the first side wall by a third living hinge, and a second end panel connected to a second end of the central panel by a fourth living hinge and to the second side wall by a fifth living hinge, wherein the inner wall includes a semi-rigid material having a stiffness greater than stiffnesses of the base panel and the peripheral wall;

a first fastener including one or more straps, wherein the first fastener is configured to removably attach the central panel to the first side wall;

a second fastener including one or more straps, wherein the second fastener is configured to removably attach the central panel to the second side wall; and a third fastener extending along a portion of a perimeter of the cover panel, wherein the third fastener is configured to fasten to the peripheral wall, wherein:

the inner wall is operable between a first position having the central panel spaced apart from the end wall of the bag and a second position having the central panel abutting the end wall of the bag, a material and/or a stiffness of the central panel is configured such that, when the inner wall is in the second position, the central panel adds structural integrity to a bottom of the backpack such that the bottom of the backpack has a greater structural integrity in the second position than in the first position, when the inner wall is in the first position, the chamber is partitioned into a first sub-chamber and a second sub-chamber, the first sub-chamber is defined between the end wall and the inner wall and has a size configured to store at least one pair of shoes, and the cover panel is configured to fasten to the peripheral wall such that, when the inner wall is in the first position, the cover panel covers the first and second sub-chambers and secures the at least one pair of shoes during transport.

20. The portable backpack of claim 19, wherein:

the peripheral wall and the base panel include a polymer foam surrounded by water-resistant fabric;

each of the central panel, the first end panel, and the second end panel include a soft outer layer configured to provide cushioning;

each of the central panel, the first panel, and the second panel include a polymeric material and/or a fabric;

the central panel, the first panel, and the second panel each have a first thickness providing a first stiffness, and the second living hinge and the fourth living hinge have a second thickness providing a second stiffness that is less than the first stiffness;

the first living hinge is a flexible piece of fabric;

the cover panel includes a foam and/or a fabric;

the first fastener includes a tab having a first end attached to the central panel and a second end configured to removably attach to the first side wall;

the second fastener includes a tab having a first end attached to the central panel and a second end configured to removably attach to the second side wall; and the third fastener includes a zipper.

* * * * *